United States Patent [19]

Sartor et al.

[11] Patent Number: 5,062,226

[45] Date of Patent: Nov. 5, 1991

[54] HEEL SECURING DEVICE, PARTICULARLY FOR SKI BOOTS

[75] Inventors: Mariano Sartor, Montebelluna; Roberto Gorza, Feltre, both of Italy

[73] Assignee: Nordica S. p. A., Montebelluna, Italy

[21] Appl. No.: 450,500

[22] Filed: Dec. 14, 1989

[30] Foreign Application Priority Data

Dec. 23, 1988 [IT] Italy ..... 82620A/88

[51] Int. Cl.[5] ..... A43B 5/04

[52] U.S. Cl. ..... 36/117; 36/119

[58] Field of Search ..... 36/119, 120, 121, 117, 36/118

[56] References Cited

U.S. PATENT DOCUMENTS

| | | | |
|---|---|---|---|
| 4,581,831 | 4/1986 | Kirsch | 36/119 |
| 4,590,691 | 5/1986 | Oliviero | 36/119 |
| 4,615,127 | 10/1986 | Delery | 36/119 |
| 4,724,625 | 2/1988 | Sartor | 36/117 |
| 4,724,626 | 2/1988 | Baggio | 36/117 |
| 4,897,940 | 2/1990 | Sartor | 36/121 |

FOREIGN PATENT DOCUMENTS

| | | | |
|---|---|---|---|
| 85026 | 8/1983 | European Pat. Off. | 36/118 |
| 0158574 | 10/1985 | European Pat. Off. . | |
| 0278245 | 8/1988 | European Pat. Off. | 36/117 |
| 363778 | 4/1990 | European Pat. Off. | 36/119 |
| 3504002 | 8/1986 | Fed. Rep. of Germany | 36/117 |
| 3721620 | 1/1988 | Fed. Rep. of Germany . | |
| 2613914 | 10/1988 | France . | |

*Primary Examiner*—Paul T. Sewell
*Assistant Examiner*—M. Denise Patterson
*Attorney, Agent, or Firm*—Guido Modiano; Albert Josif

[57] ABSTRACT

The securing device includes a rear quarter associated with a shell, and a flap which embraces the rear heel region. The device further has at least one rod-like element which is freely articulated to the rear quarter and interacts, by means of a plate, with the flap upon fastening of the quarter. A resilient member is advantageously provided and interacts with the rod-like element.

12 Claims, 2 Drawing Sheets

9
219
210
216
4
217
218
213
1

216
4
218
210
215
213
9

13
113
110
4
114
115
1

110
115
13
114
1
113

HEEL SECURING DEVICE, PARTICULARLY FOR SKI BOOTS

BACKGROUND OF THE INVENTION

The present invention relates to a heel securing device, particularly usable in ski boots of the rear-entry type.

Numerous devices are currently known which allow to secure the heel inside the shell.

Known heel securing devices are known generally constituted by a flap provided at the shell to embrace the heel region which interact with a presser. The presser may be constituted by a threaded stem which interacts with a complementarily threaded seat provided at the rear quarter and which can be activated by means of an adapted knob which can be accessed by the skier.

One such device is, for example, disclosed in U.S. Pat. No. 4,615,127.

This known device has disadvantages: first of all, the adjustment of the securing of the foot must occur by means of the skier's activation of the knob or similar, and this operation must be performed, both to secure and to release the foot, while the skier is crouching and therefore in a very uncomfortable position.

U.S. patent application Ser. No. 07/240,908 filed Sept. 7, 1988 discloses a heel securing device activated by closing the quarters and constituted by a lever connecting the rear quarter with an inner flap. This device, though, aims at simplifying the insertion of the foot in the ski boot by opening the heel flap automatically when the quarter is opened.

SUMMARY OF THE INVENTION

The aim of the present invention is to provide an automatic fastening of the heel securing device upon fastening of the quarters and a further aim is to eliminate the disadvantages described above in known types.

Within the scope of the above described aim, another important object is to provide a device which is structurally very simple as well as safe and reliable in use.

Another object is to provide a device which has a very compact structure with no elements which protrude considerably from the boot to alter its aesthetics and safety.

Not least object is to provide a device which associates with the preceding characteristics that of having modest costs.

The above described aim and objects, as well as others which will become apparent hereinafter, are achieved by a heel securing device, particularly for ski boots comprising at least a rear quarter which is associated with a shell, said ski boots having at least a flap embracing the rear region of the heel, characterized in that it comprises a fastening element adapted to control the fastening of said quarter, a plate member adapted to act upon said flap to secure the heel upon fastening of said quarter, said fastening element being adapted to operate said plate member upon fastening of said quarter.

Said securing device advantageously comprises means for the presettable adjustment of the movement which can be imparted to said plate.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
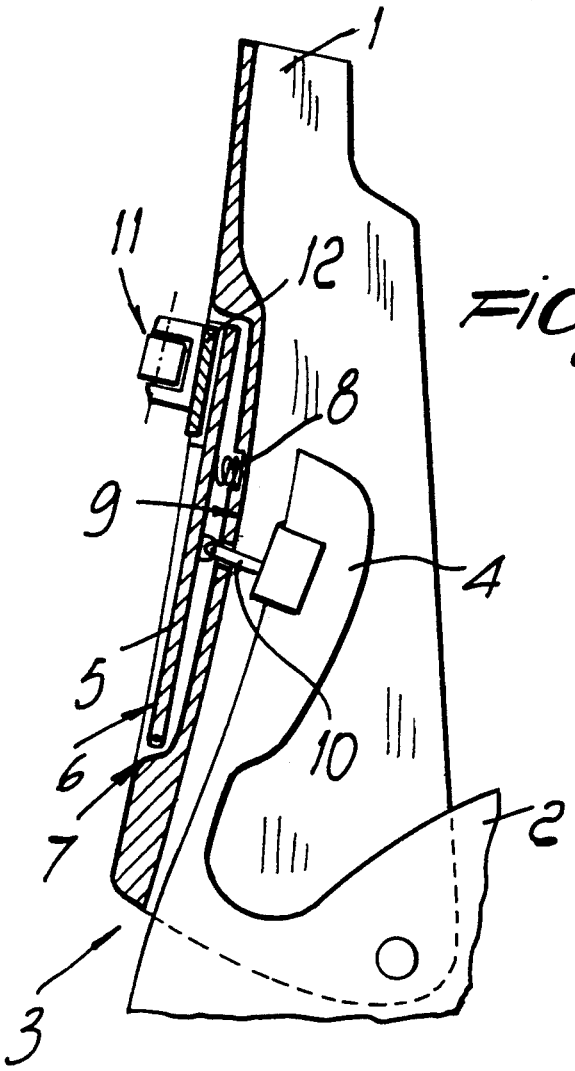
FIG. 1 is a sectional partial side view, taken along a median sectional plane which is longitudinal to the rear quarter, of a ski boot having the device according to the invention.
Figure 3:
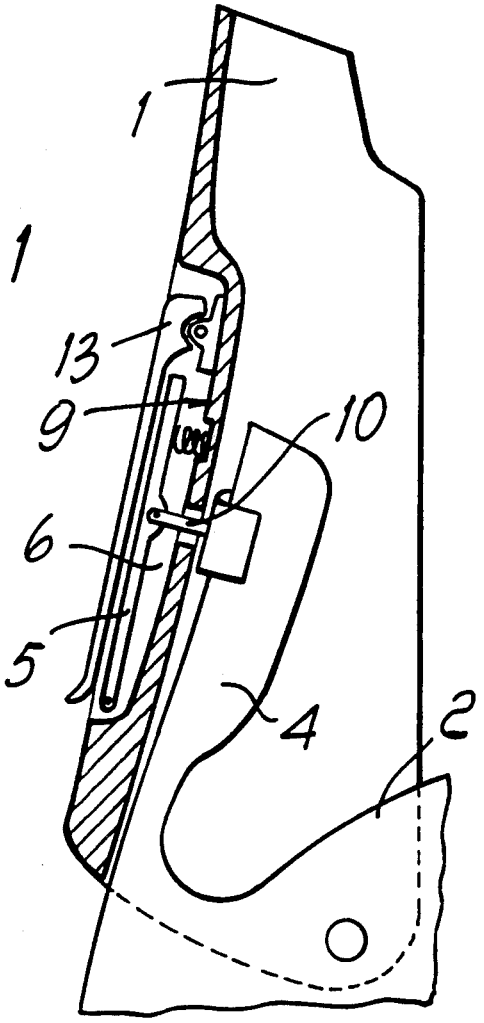
FIG. 3 is a view, similar to that of FIG. 1, of a ski boot according to another aspect of the invention.

With reference to the figures, the reference numeral 1 indicates the rear quarter of a ski boot of the rear-entry type, articulated at a shell 2.

Said shell has, at the heel region 3, a flap 4 which protrudes therefrom and is adapted to embrace the region of the leg which overlies said heel.

The securing device is constituted by at least one rodlike element 5 which is arranged longitudinally with respect to the rear quarter 1 and is transversely pivoted thereto, within an adapted first seat 6, proximate to its lower end 7.

Said rod-like element 5 preferably interacts in contrast with a resilient member 8 constituted by an adapted spring interposed between said rod-like element and the surface 9 of said first seat 6 which is arranged facing it.

An abutment member 10 is associated with the rod-like element 5 and is preferably articulated thereto; said abutment member 10 comprises a plate which rests or abuts behind said flap 4 and a stem which protrudes through a seat said rear quarter and is then articulated, as previously mentioned, to said rod-like element 5.

Said rod-like element is activated if the means for fastening front and rear quarters are in turn activated; said quarters fastening means may be constituted, for example, by a horizontal lever 11 which actuates a toothed strap 12 which presses at the end of the rod-like element 5 which is opposite to the end pivoted to the rear quarter 1.

Said quarters fastening means can otherwise be constituted by a vertical lever 13 pivoted to said rear quarter 1 within said seat 6 on the opposite side with respect to said rod-like element 5.

Said device advantageously comprises means for the presettable adjustment of the movement which can be imparted to the abutment member 10; said means (shown in FIG. 4) may be constituted by a screw 14 associated with a complementarily threaded seat provided at the rod-like element 5 which interacts with the end of the stem of the abutment member 10. It is thus possible, upon the activation of the device, to achieve a different movement and therefore a different inclination of the flap inside the boot.

Figure 5:
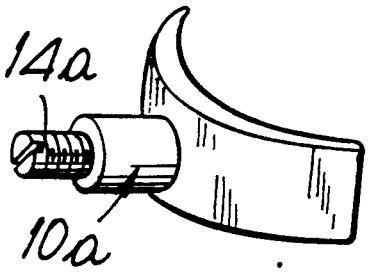
FIG. 5 is a perspective detail view of a further means for the presettable adjustment of the device.

Said means may alternately be constituted again by a screw 14*a* which is rotatably associated at a preset axial seat provided on the stem 10*a* of the abutment member as illustrated in FIG. 5; said stem is freely rotatably associated at the rod-like element 5.

The use of the device is therefore as follows: during the closure of the horizontal lever 11 or of the vertical lever 13 for fastening the quarters, a movement is imparted to the rod-like element 5 which compresses the resilient member 8 and imparts a movement to the stem and plate of the abutment member 10, which forces the flap 4 to secure the heel of the foot.

It can thus be seen that the fastening of the quarters can automatically allow the optimum securing of the foot inside the boot.

Said securing can also be achieved by the means which adjust and preset the movement which can be imparted to the plate of the abutment member upon the fastening of the quarters.

It has thus been observed that the invention has achieved the intended aim and objects, a device having been provided which allows to achieve, by means of a rapid and simple actuation, the optimum securing of the foot inside the boot.

The structure of the device is furthermore very simple and compact, and this allows to keep the shapes of the boot very "clean".

The device is very economical and reliable in use also by virtue of the small number of its components.

The device according to the invention is naturally susceptible to numerous modifications and variations, all of which are within the scope of the same inventive concept.

Figures 6, 7, 8, 9:
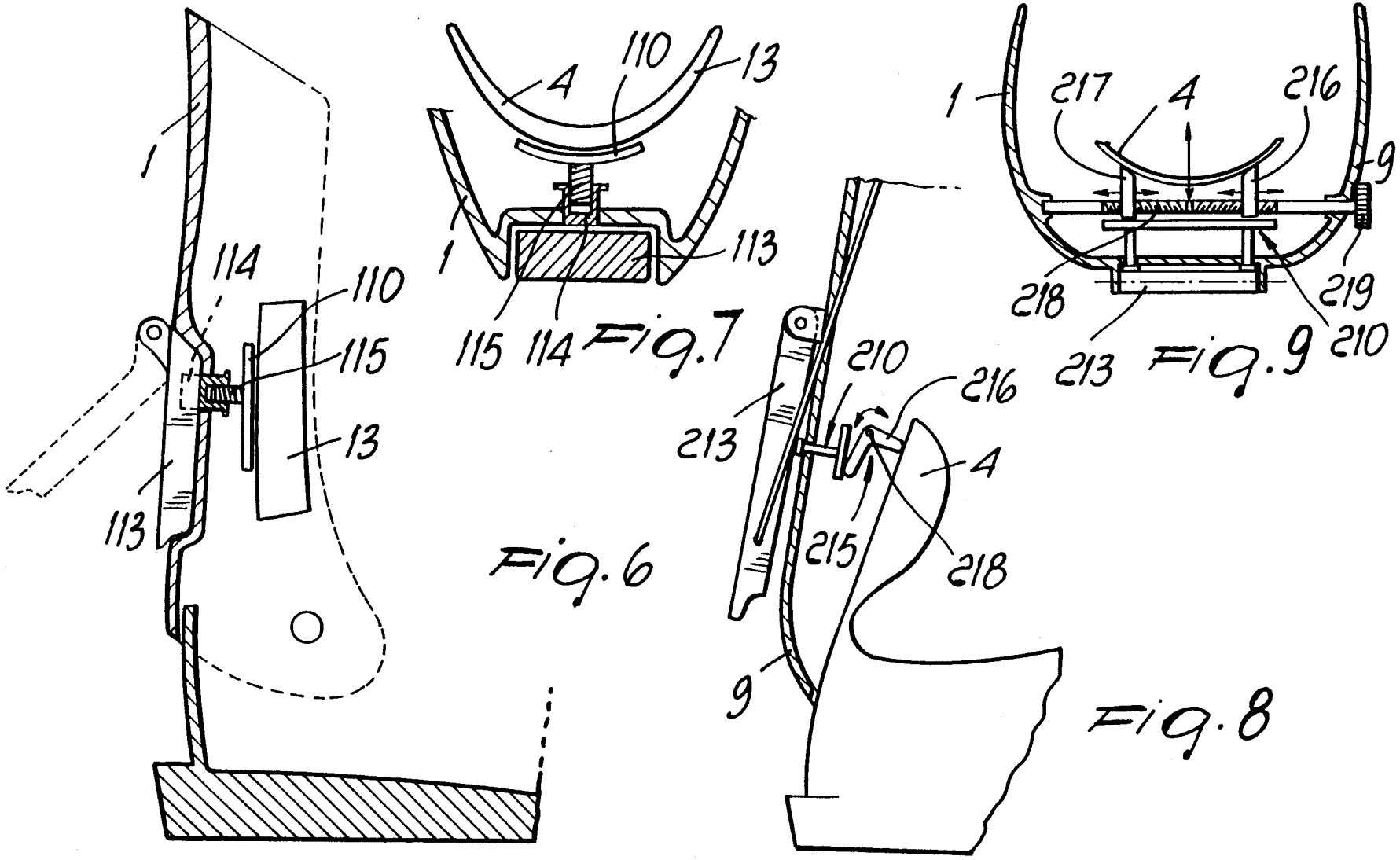
FIG. 6 is a view similar to FIG. 1, of a ski boot according to a further aspect of the invention.
FIG. 7 is a top sectioned view of a detail of the ski boot of FIG. 6.
FIG. 8 is a view similar to FIG. 1, of a ski boot according to still a further aspect of the invention.
FIG. 9 is a top sectioned view of a detail of the ski boot of FIG. 8.

For example, FIGS. 6 and 7 show another embodiment of the invention wherein a vertical lever 113, for fastening the quarters in a per se known manner, directly actuates an abutment member plate 110.

The plate 110 is interposed between the lever 113 and the flap 4.

Figure 4:
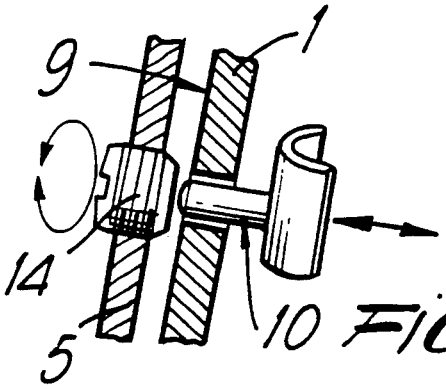
FIG. 4 is a sectional partial side view of a means for the presettable adjustment of the device.
Figure 2:
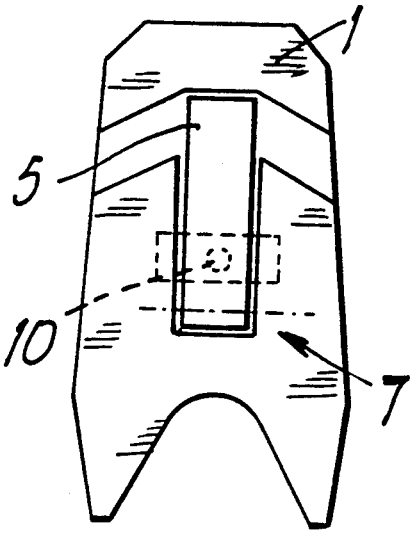
FIG. 2 is a partial rear view of the ski boot of FIG. 1, wherein the quarters fastening device has been omitted for the sake of clarity.

The plate 110 advantageously has a sleeve 114 inserted in an adapted seat at the rear quarter and engaging a threaded stem 115 in order to adjust the position of the plate 110 in a manner similar to that of the device shown in FIGS. 4 and 5.

FIGS. 8 and 9 show a ski boot with a device according to a further aspect of the invention.

A vertical lever 213, for fastening the quarters, actuates an abutment member plate 210 similarly to the device of FIGS. 6, 7. The plate 210 in turn actuates a toggle member 215 acting on a flap 4.

The toggle member 215 is constituted by two L-shaped levers 216 and 217 pivoted at a double-threaded control bar 218.

The control bar 218 is mounted on the quarter 1 and can be turned by means of a knob 219 to adjust the mutual distance of the levers 216 and 217 and hence the action on the flap 4.

The materials and dimensions which constitute the individual components of the device must naturally be the most appropriate according to the specific requirements.

We claim:

1. Heel securing device, particularly for ski boots comprising a shell, a rear quarter and a front quarter articulated to said shell, and a flap means arranged at the heel region of the ski boot for embracing the heel of the foot, said device comprising an abutment member for abutting against the flap means of the ski boot, said abutment member comprising a stem means protruding through a seat means provided in said rear quarter at the heel region thereof, the ski boot further comprising quarters fastener means for the mutual fastening together of the rear and front quarters about the wearer's leg, said quarters fastener means being connected to said rear quarter, wherein said quarters fastener means engage with said stem means upon a quarters closing activation of said quarters fastening means to move said stem means in said seat means relative to said rear quarter, thereby said abutment member provides an abutting securement adjustment of said flap means about the heel.

2. Device according to claim 1, wherein said quarters fastener means comprise a lever means rotatably pivoted to said rear quarter, said lever means engage with said stem means upon a quarters closing rotation activation of said lever means.

3. Device according to claim 1, wherein said quarters fastener means comprise a horizontal lever means rotatably pivoted to said rear quarter, said rear quarter being provided with a first seat at the heel region thereof, said device further comprising a rodlike element pivoted to said rear quarter at a lower end of said first seat thereof, said rodlike element extending upwardly in said first seat and defining a middle portion to which is pivotally connected said stem means of said abutment element, and an upper end which is pressed by a toothed strap activated by a quarters closing rotation activation of said horizontal lever means, a resilient spring member being furthermore provided which is interconnected between said rod element and said first seat at a point above said seat means of said rear quarter.

4. Device according to claim 1, wherein said quarters fastener means comprise a vertical lever means rotatably pivoted to said rear quarter, said rear quarter being provided with a first seat at the heel region thereof, said device further comprising a rodlike element pivoted to said rear quarter at a lower end of said first seat thereof, said rodlike element extending upwardly in said first seat and defining a middle portion to which is pivotally connected said stem means of said abutment element, a resilient spring member being furthermore provided which is interconnected between said rodlike element and said first seat at a point above said seat means of said rear quarter, said rodlike element being pressed by said vertical lever means upon a quarters closing rotation activation of said vertical lever means thereof.

5. Device according to claim 3, further comprising presettable adjustment means for the presettable adjustment of the movement which can be imparted to said abutment member, said presettable adjustment means comprising a screw rotatably inserted in a complimentarily threaded seat provided in said rodlike element, said screw having an end which engages with said stem means of said abutment member.

6. Device according to claim 4, further comprising presettable adjustment means for the presettable adjustment of the movement which can be imparted to said abutment member, said presettable adjustment means comprising a screw rotatably inserted in a complimentarily threaded seat provided in said rodlike element, said screw having an end which engages with said stem means of said abutment member.

7. Device according to claim 3, further comprising presettable adjustment means for the presettable adjustment of the movement which can be imparted to said abutment member, said presettable adjustment means comprising a screw rotatably inserted in a axial seat provided in said stem means of said abutment member.

8. Device according to claim 4, further comprising presettable adjustment means for the presettable adjustment of the movement which can be imparted to said abutment member, said presettable adjustment means comprising a screw rotatably inserted in a axial seat provided in said stem means of said abutment member.

9. Device according to claim 1, wherein said abutment member further comprises a plate means rigidly connected to said stem means, said plate means being provided with a curved configuration for mating with said flap means.

10. Device according to claim 9, wherein said stem means comprises an external sleeve and an internal threaded stem rigidly connected to said plate means, said internal threaded stem being threadingly engaged in said external sleeve.

11. Heel securing device, particularly for ski boots comprising a shell, a rear quarter and a front quarter articulated to said shell, and a flap means arranged at the heel region of the ski boot for embracing the heel of the foot, at least one of said quarters being rotatably pivoted to said shell, said device comprising an abutment member for abutting member comprising a stem means protruding through a seat means provided in said rear quarter at the heel region thereof, the ski boot further comprising quarters fastener means for the mutual fastening together of the rear and front quarters about the wearer's leg, said quarters fastener means comprising a lever means being pivotally connected to said rear quarter, wherein said lever means of said quarters fastener means engage with said stem means upon a quarters closing rotation activation of said lever means to move said stem means in said seat means relative to said rear quarter, thereby said abutment member provides an abutting securement adjustment of said flap means at the heel.

12. In a rear-entry ski boot comprising a shell, a front quarter connected to said shell, a rear-quarter rotatably articulated to said shell, and a flap means arranged at the heel region of the ski boot for embracing the heel of the foot, a heel securing device comprising an abutment member for abutting against the flap means of the ski boot, said abutment member comprising a stem means protruding through a seat means provided in said rear quarter at the heel region thereof, the ski boot further comprising quarters fastener means for the mutual fastening together of the rear and front quarters about the wearer's leg, said quarters fastener means comprising a lever means being pivotally connected to said rear quarter, wherein said lever means of said quarters fastener means engage with said stem means upon a quarters closing rotation activation of said lever means to move said stem means in said seat means relative to said rear quarter, thereby said abutment member provides a securing adjustment of said flap means about the heel.

* * * * *